US007243493B2

(12) United States Patent
Ma et al.

(10) Patent No.: US 7,243,493 B2
(45) Date of Patent: Jul. 17, 2007

(54) VALVE GRADUALLY COMMUNICATING A PRESSURE SIGNAL

(75) Inventors: Pengfei Ma, Naperville, IL (US); Jiao Zhang, Naperville, IL (US); Jeff L. Kuehn, Metamora, IL (US); Kalpesh N. Patel, Romeoville, IL (US)

(73) Assignees: Caterpillar Inc, Peoria, IL (US); Shin Caterpillar Mitsubishi Ltd (JP)

( * ) Notice: Subject to any disclaimer, the term of this patent is extended or adjusted under 35 U.S.C. 154(b) by 13 days.

(21) Appl. No.: 11/117,384

(22) Filed: Apr. 29, 2005

(65) Prior Publication Data

US 2006/0243129 A1 Nov. 2, 2006

(51) Int. Cl.
*F15B 13/04* (2006.01)

(52) U.S. Cl. ..... 60/450; 91/454; 137/625.25

(58) Field of Classification Search ..... 60/450, 60/452, 468; 91/446, 448, 452, 454; 137/625.25, 137/625.35, 625.48
See application file for complete search history.

(56) References Cited

U.S. PATENT DOCUMENTS

| | | | |
|---|---|---|---|
| 3,366,202 | A | 1/1968 | James |
| 4,046,270 | A | 9/1977 | Baron et al. |
| 4,222,409 | A | 9/1980 | Budzich |
| 4,250,794 | A | 2/1981 | Haak et al. |
| 4,316,486 | A | 2/1982 | Tandrup et al. |
| 4,416,187 | A | 11/1983 | Nystrom |
| 4,437,385 | A | 3/1984 | Kramer et al. |
| 4,480,527 | A | 11/1984 | Lonnemo |
| 4,581,893 | A | 4/1986 | Lindbom |
| 4,586,330 | A | 5/1986 | Watanabe et al. |
| 4,623,118 | A | 11/1986 | Kumar |
| 4,662,601 | A | 5/1987 | Andersson |
| 4,706,932 | A | 11/1987 | Yoshida et al. |

(Continued)

FOREIGN PATENT DOCUMENTS

JP 02613041 B2 5/1997

OTHER PUBLICATIONS

U.S. Appl. No. 11/117,385 filed Apr. 29, 2005.

*Primary Examiner*—Michael Leslie
(74) *Attorney, Agent, or Firm*—Finnegan, Henderson, Farabow, Garrett & Dunner

(57) ABSTRACT

A valve is provided for a hydraulic system having a source of pressurized fluid, a fluid actuator, and a proportional pressure compensating valve. The valve has a bore in fluid communication with the source and the fluid actuator. The valve also has a valve element disposed in the bore and movable between a flow blocking position and a flow passing position to selectively fluidly communicate the source with the fluid actuator. The valve also has a valve signal passageway disposed within the valve element and configured to be in fluid communication with a pressurized fluid having a signal pressure indicative of pressure supplied to the fluid actuator. The valve further has first and second orifices disposed within the valve element in fluid communication with the valve signal passageway and the bore. The valve signal passageway is configured to communicate the signal pressure with the first and second orifices. Movement of the valve element from the flow blocking position to the flow passing position fluidly communicates the first orifice with a system signal passageway before the second orifice, and fluidly communicates both the first and second orifices with the system signal passageway when the valve element is in the flow passing position.

24 Claims, 2 Drawing Sheets

U.S. PATENT DOCUMENTS 4,711,267 A 12/1987 Schwelm
4,747,335 A 5/1988 Budzich
4,799,420 A 1/1989 Budzich
5,137,254 A 8/1992 Aardema et al.
5,152,142 A 10/1992 Budzich
5,161,575 A * 11/1992 Morikawa et al. ..... 91/446
5,211,196 A 5/1993 Schwelm
5,287,794 A 2/1994 Andersson
5,297,381 A 3/1994 Eich et al.
5,313,873 A 5/1994 Gall et al.
5,350,152 A 9/1994 Hutchison et al.
5,366,202 A 11/1994 Lunzman
5,447,093 A 9/1995 Budzich
5,477,677 A 12/1995 Krnavek
5,537,818 A 7/1996 Hosseini et al.
5,553,452 A 9/1996 Snow et al.
5,568,759 A 10/1996 Aardema
5,678,470 A 10/1997 Koehler et al.
5,701,933 A 12/1997 Lunzman
5,787,963 A * 8/1998 Tsuji et al. ..... 164/120
5,813,226 A 9/1998 Krone
5,813,309 A 9/1998 Taka et al.
5,857,330 A 1/1999 Ishizaki et al.
5,868,059 A 2/1999 Smith
5,878,647 A 3/1999 Wilke et al.
5,890,362 A 4/1999 Wilke
5,947,140 A 9/1999 Aardema et al.
5,960,695 A 10/1999 Aardema et al.
6,009,708 A 1/2000 Miki et al.
6,026,730 A 2/2000 Yoshida et al.
6,082,106 A 7/2000 Hamamoto
6,216,456 B1 4/2001 Mitchell
6,367,365 B1 4/2002 Weickert et al.
6,397,655 B1 6/2002 Stephenson
6,408,622 B1 6/2002 Tsuruga et al.
6,467,264 B1 10/2002 Stephenson et al.
6,502,393 B1 1/2003 Stephenson et al.
6,502,500 B2 1/2003 Yoshino
6,516,614 B1 2/2003 Knoll
6,598,391 B2 7/2003 Lunzman et al.
6,619,183 B2 9/2003 Yoshino
6,655,136 B2 12/2003 Holt et al.
6,662,705 B2 12/2003 Huang et al.
6,665,136 B2 12/2003 Holt et al.
6,691,603 B2 2/2004 Linerode et al.
6,694,860 B2 2/2004 Yoshino
6,715,402 B2 4/2004 Pfaff et al.
6,718,759 B1 4/2004 Tabor
6,725,131 B2 4/2004 Lunzman
6,732,512 B2 5/2004 Pfaff et al.
6,748,738 B2 6/2004 Smith
6,761,029 B2 7/2004 Linerode
2003/0121256 A1 7/2003 Mather
2003/0121409 A1 7/2003 Lunzman et al.
2003/0125840 A1 7/2003 Lunzman et al.
2003/0196545 A1 10/2003 Jensen et al.
2004/0055288 A1 3/2004 Pfaff et al.
2004/0055289 A1 3/2004 Pfaff et al.
2004/0055452 A1 3/2004 Tabor
2004/0055453 A1 3/2004 Tabor
2004/0055454 A1 3/2004 Pfaff et al.
2004/0055455 A1 3/2004 Tabor et al.
2006/0090460 A1 5/2006 Ma et al.

* cited by examiner

VALVE GRADUALLY COMMUNICATING A PRESSURE SIGNAL

TECHNICAL FIELD

The present disclosure relates generally to a valve, and more particularly, to a valve gradually communicating a pressure signal.

BACKGROUND

Hydraulic circuits are often used to control the operation of hydraulic actuators of work machines. These hydraulic circuits typically include valves that are fluidly connected between a pump and the actuators to control a flow rate and direction of pressurized fluid to and from chambers of the actuator. In some instances, multiple actuators may be connected to a common pump causing undesirable pressure fluctuations within the hydraulic circuits during operation of the actuators. In particular, the pressure of a fluid supplied to one actuator may undesirably fluctuate in response to operation of a different actuator fluidly connected to the same pump. These pressure fluctuations may cause inconsistent and/or unexpected actuator movements. In addition, the pressure fluctuations may be severe enough and/or occur often enough to cause malfunction or premature failure of hydraulic circuit components.

One method of reducing these pressure fluctuations within the fluid supplied to a hydraulic actuator is described in U.S. Pat. No. 5,878,647 ("the '647 patent") issued to Wilke et al. on Mar. 9, 1999. The '647 patent describes a hydraulic circuit having two pairs of solenoid valves, a variable displacement pump, a reservoir tank, and a hydraulic actuator. One pair of the solenoid valves includes a head-end supply valve and a head-end return valve and connects a head end of the hydraulic actuator to either the variable displacement pump or the reservoir tank. The other pair of solenoid valves includes a rod-end supply valve and a rod-end return valve and connects a rod end of the hydraulic actuator to either the variable displacement pump or the reservoir tank. Each of these four solenoid valves is associated with a different pressure compensating check valve. Each pressure compensating check valve is connected between the respective solenoid valve and the actuator to control a pressure of the fluid between the associated valve and the actuator.

Although the multiple pressure compensating valves of the hydraulic circuit described in the '647 patent may reduce pressure fluctuations within the hydraulic circuit, they may increase the cost and complexity of the hydraulic circuit. In addition, the pressure compensating valves of the '647 patent may not control the pressures within the hydraulic circuit precise enough for optimal performance of the associated actuator.

Additionally, hydraulically actuated pressure compensating valves may cause undesirable pressure fluctuations within the hydraulic circuit if biased by significantly low pressure signals. Such pressure signals may communicate significantly low pressure pulses to the pressure compensating valve that could cause rapid movement of the pressure compensating valve element. This rapid movement may result in a pressure surge through the hydraulic circuit and, if communicated to the actuator, may cause undesirable and/or jerky operation of the actuator.

The disclosed valve is directed to overcoming one or more of the problems set forth above.

SUMMARY OF THE INVENTION

In one aspect, the present disclosure is directed to a valve for a hydraulic system including a source of pressurized fluid, a fluid actuator, and a proportional pressure compensating valve. The valve includes a bore in fluid communication with the source and the fluid actuator. The valve also includes a valve element disposed in the bore and movable between a flow blocking position and a flow passing position to selectively fluidly communicate the source with the fluid actuator. The valve also includes a valve signal passageway disposed within the valve element and configured to be in fluid communication with a pressurized fluid having a signal pressure indicative of pressure supplied to the fluid actuator. The valve further includes first and second orifices disposed within the valve element in fluid communication with the valve signal passageway and the bore. The valve signal passageway is configured to communicate the signal pressure with the first and second orifices. Movement of the valve element from the flow blocking position to the flow passing position fluidly communicates the first orifice with a system signal passageway before the second orifice, and fluidly communicates both the first and second orifices with the system signal passageway when the valve element is in the flow passing position.

In another aspect, the present disclosure is directed to a method of operating a valve. The method includes pressurizing a fluid, directing pressurized fluid to the valve, and moving a valve element between a flow blocking position and a flow passing position to selectively communicate pressurized fluid to a fluid actuator. The method also includes directing pressurized fluid having a signal pressure indicative of pressure supplied to the fluid actuator through a valve signal passageway disposed within the valve element. The method further includes communicating pressurized fluid through a first orifice disposed within the valve element with a system signal passageway as the valve element moves from a flow blocking position to a flow passing position before communicating pressurized fluid through a second orifice disposed within the valve element with the system signal passageway as the valve element moves from the flow blocking position to the flow passing position.

DETAILED DESCRIPTION

Figure 1:
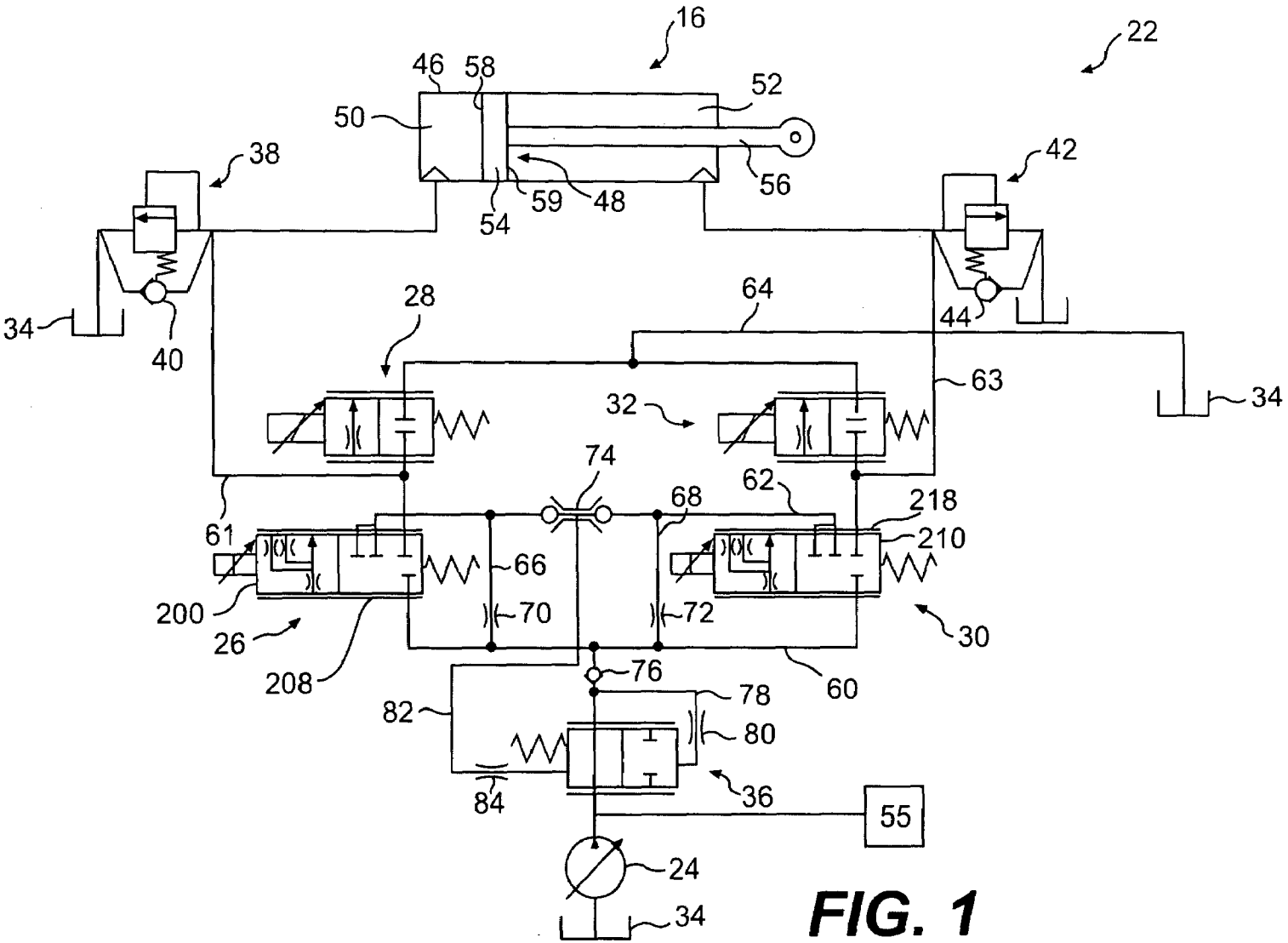
FIG. 1 is a schematic illustration of an exemplary disclosed hydraulic circuit.

FIG. 1 illustrates a hydraulic cylinder 16 that may be connected to various work machine components, such as, for example, linkages (not shown), work implements (not shown), and/or frames (not shown). Hydraulic system 22 may include various components that cooperate to actuate hydraulic cylinder 16. Hydraulic system 22 may include a source 24 of pressurized fluid, a head-end supply valve 26, a head-end drain valve 28, a rod-end supply valve 30, a rod-end drain valve 32, a head-end pressure relief valve 38, a head-end makeup valve 40, a rod-end pressure relief valve 42, a rod-end makeup valve 44, a shuttle valve 74, a tank 34, and a proportional pressure compensating valve 36. It is contemplated that hydraulic system 22 may include additional and/or different components such as, for example, a pressure sensor, a temperature sensor, a position sensor, a controller, an accumulator, and other components known in the art.

Hydraulic cylinder 16 may include a tube 46 and a piston assembly 48 disposed within tube 46. One of tube 46 and piston assembly 48 may be pivotally connected to a first machine component (not shown), while the other of tube 46 and piston assembly 48 may be pivotally connected to a second machine component (not shown). Hydraulic cylinder 16 may include a first chamber 50 and a second chamber 52 separated by piston assembly 48. The first and second chambers 50, 52 may be selectively supplied with a fluid pressurized by source 24 and fluidly connected with tank 34 to cause piston assembly 48 to displace within tube 46, thereby changing the effective length of hydraulic cylinder 16. The expansion and retraction of hydraulic cylinder 16 may function to assist in moving one or both of the machine components connected to hydraulic cylinder 16.

Piston assembly 48 may include a piston 54 axially aligned with and disposed within tube 46, and a piston rod 56 connectable to one of first and second machine components. Piston 54 may include a first hydraulic surface 58 and a second hydraulic surface 59 opposite first hydraulic surface 58. An imbalance of force caused by fluid pressure on first and second hydraulic surfaces 58, 59 may result in movement of piston assembly 48 within tube 46. For example, a force on first hydraulic surface 58 being greater than a force on second hydraulic surface 59 may cause piston assembly 48 to displace to increase the effective length of hydraulic cylinder 16. Similarly, when a force on second hydraulic surface 59 is greater than a force on first hydraulic surface 58, piston assembly 48 will retract within tube 46 to decrease the effective length of hydraulic cylinder 16. A sealing member (not shown), such as an o-ring, may be connected to piston 54 to restrict a flow of fluid between an internal wall of tube 46 and an outer cylindrical surface of piston 54.

Source 24 may be configured to produce a flow of pressurized fluid and may include a pump such as, for example, a variable displacement pump, a fixed displacement pump, or any other source of pressurized fluid known in the art. Source 24 may be drivably connected to a power source (not shown) of a work machine by, for example, a countershaft (not shown), a belt (not shown), an electrical circuit (not shown), or in any other suitable manner. Source 24 may be dedicated to supplying pressurized fluid only to hydraulic system 22, or alternately may supply pressurized fluid to additional hydraulic systems 55 within a work machine.

Head-end supply valve 26 may be disposed between source 24 and first chamber 50 and configured to regulate a flow of pressurized fluid to first chamber 50. Specifically, head-end supply valve 26 may include a two-position spring biased gradual flow valve element 200 supported in a bore 208. Gradual flow valve element 200 may be solenoid actuated and configured to move between a first position at which fluid is blocked from flowing to first chamber 50 and a second position at which fluid flow is allowed to flow to first chamber 50. It is contemplated that head-end supply valve 26 may alternately be hydraulically actuated, mechanically actuated, pneumatically actuated, or actuated in any other suitable manner.

Head-end drain valve 28 may be disposed between first chamber 50 and tank 34 and configured to regulate a flow of pressurized fluid from first chamber 50 to tank 34. Specifically, head-end drain valve 28 may include a two-position spring biased valve mechanism that is solenoid actuated and configured to move between a first position at which fluid is allowed to flow from first chamber 50 and a second position at which fluid is blocked from flowing from first chamber 50. It is contemplated that head-end drain valve 28 may include additional or different valve mechanisms such as, for example, a proportional valve element or any other valve mechanism known in the art. It is also contemplated that head-end drain valve 28 may alternately be hydraulically actuated, mechanically actuated, pneumatically actuated, or actuated in any other suitable manner.

Rod-end supply valve 30 may be disposed between source 24 and second chamber 52 and configured to regulate a flow of pressurized fluid to second chamber 52. Specifically, rod-end supply valve 30 may include a two-position spring biased gradual flow valve element 210 supported in a bore 218. Gradual flow valve element 210 may be solenoid actuated and configured to move between a first position at which fluid is blocked from flowing to second chamber 52 and a second position at which fluid is allowed to flow to second chamber 52. It is contemplated that rod-end supply valve 30 may alternately be hydraulically actuated, mechanically actuated, pneumatically actuated, or actuated in any other suitable manner.

Rod-end drain valve 32 may be disposed between second chamber 52 and tank 34 and configured to regulate a flow of pressurized fluid from second chamber 52 to tank 34. Specifically, rod-end drain valve 32 may include a two-position spring biased valve mechanism that is solenoid actuated and configured to move between a first position at which fluid is allowed to flow from second chamber 52 and a second position at which fluid is blocked from flowing from second chamber 52. It is contemplated that rod-end drain valve 32 may include additional or different valve mechanisms such as, for example, a proportional valve element or any other valve mechanism known in the art. It is also contemplated that rod-end drain valve 32 may alternately be hydraulically actuated, mechanically actuated, pneumatically actuated, or actuated in any other suitable manner.

Head-end and rod-end supply and drain valves 26, 28, 30, 32 may be fluidly interconnected. In particular, head-end and rod-end supply valves 26, 30 may be connected in parallel to an upstream common supply fluid passageway 60 and connected to a downstream system signal fluid passageway 62. Head-end and rod-end drain valves 28, 32 may be connected in parallel to a common drain passageway 64. Head-end supply and return valves 26, 28 may be connected in parallel to a first chamber fluid passageway 61 and rod-end supply and return valves 30, 32 may be connected in parallel to a common second chamber fluid passageway 63.

Head-end pressure relief valve 38 may be fluidly connected to first chamber fluid passageway 61 between first chamber 50 and head-end supply and drain valves 26, 28. Head-end pressure relief valve 38 may have a valve element spring biased toward a valve closing position and movable to a valve opening position in response to a pressure within first chamber fluid passageway 61 being above a predetermined pressure. In this manner, head-end pressure relief valve 38 may be configured to reduce a pressure spike within hydraulic system 22 caused by external forces acting on work implement 14 and piston 54 by allowing fluid from first chamber 50 to drain to tank 34.

Head-end makeup valve 40 may be fluidly connected to first chamber fluid passageway 61 between first chamber 50 and head-end supply and drain valves 26, 28. Head-end makeup valve 40 may have a valve element configured to allow fluid from tank 34 into first chamber fluid passageway 61 in response to a fluid pressure within first chamber fluid passageway 61 being below a pressure of the fluid within tank 34. In this manner, head-end makeup valve 40 may be configured to reduce a drop in pressure within hydraulic system 22 caused by external forces acting on work implement 14 and piston 54 by allowing fluid from tank 34 to fill first chamber 50.

Rod-end pressure relief valve 42 may be fluidly connected to second chamber fluid passageway 63 between second chamber 52 and rod-end supply and drain valves 30, 32. Rod-end pressure relief valve 42 may have a valve element spring biased toward a valve closing position and movable to a valve opening position in response to a pressure within second chamber fluid passageway 63 being above a predetermined pressure. In this manner, rod-end pressure relief valve 42 may be configured to reduce a pressure spike within hydraulic system 22 caused by external forces acting on work implement 14 and piston 54 by allowing fluid from second chamber 52 to drain to tank 34.

Rod-end makeup valve 44 may be fluidly connected to second chamber fluid passageway 63 between second chamber 52 and rod-end supply and drain valves 30, 32. Rod-end makeup valve 44 may have a valve element configured to allow fluid from tank 34 into second chamber fluid passageway 63 in response to a fluid pressure within second chamber fluid passageway 63 being below a pressure of the fluid within tank 34. In this manner, rod-end makeup valve 44 may be configured to reduce a drop in pressure within hydraulic system 22 caused by external forces acting on work implement 14 and piston 54 by allowing fluid from tank 34 to fill second chamber 52.

Shuttle valve 74 may be disposed within system signal fluid passageway 62. Shuttle valve 74 may be configured to fluidly connect the one of head-end and rod-end supply valves 26, 30 having a lower fluid pressure to proportional pressure compensating valve 36 in response to a higher fluid pressure from the other of head-end or rod-end supply valves 26, 30. In this manner, shuttle valve 74 may resolve pressure signals from head-end and rod-end supply valves 26, 30 to allow the lower outlet pressure of the two valves to affect movement of proportional pressure compensating valve 36.

Tank 34 may constitute a reservoir configured to hold a supply of fluid. The fluid may include, for example, a dedicated hydraulic oil, an engine lubrication oil, a transmission lubrication oil, or any other fluid known in the art. One or more hydraulic systems within a work machine may draw fluid from and return fluid to tank 34. It is also contemplated that hydraulic system 22 may be connected to multiple separate fluid tanks.

Proportional pressure compensating valve 36 may be a hydro-mechanically actuated proportional control valve disposed between upstream common fluid passageway 60 and source 24, and may be configured to control a pressure of the fluid supplied to upstream common fluid passageway 60. Specifically, proportional pressure compensating valve 36 may include a proportional valve element that is spring and hydraulically biased toward a flow passing position and biased by hydraulic pressure toward a flow blocking position. In one embodiment, proportional pressure compensating valve 36 may be movable toward the flow blocking position by a fluid directed via a fluid passageway 78 from a point between proportional pressure compensating valve 36 and A check valve 76. A restrictive orifice 80 may be disposed within fluid passageway 78 to minimize pressure and/or flow oscillations within fluid passageway 78. Proportional pressure compensating valve 36 may be movable toward the flow passing position by a fluid directed via a fluid passageway 82 from shuttle valve 74. A restrictive orifice 84 may be disposed within fluid passageway 82 to minimize pressure and/or flow oscillations within fluid passageway 82. It is contemplated that the proportional valve element of proportional pressure compensating valve 36 may alternately be spring biased toward a flow blocking position, that the fluid from passageway 82 may alternately bias the valve element of proportional pressure compensating valve 36 toward the flow blocking position, and/or that the fluid from passageway 78 may alternately move the proportional valve element of proportional pressure compensating valve 36 toward the flow passing position. It is also contemplated that proportional pressure compensating valve 36 may alternately be located downstream of head-end and rod-end supply valves 26, 30 or in any other suitable location. It is further contemplated that restrictive orifices 80 and 84 may be omitted, if desired.

Hydraulic system 22 may include additional components to control fluid pressures and/or flows within hydraulic system 22. Specifically, hydraulic system 22 may include pressure balancing passageways 66, 68 configured to control fluid pressures and/or flows within hydraulic system 22. Pressure balancing passageways 66, 68 may fluidly connect upstream common supply fluid passageway 60 and downstream system signal fluid passageway 62. Pressure balancing passageways 66, 68 may include restrictive orifices 70, 72, respectively, to minimize pressure and/or flow oscillations within fluid passageways 66, 68. It is contemplated that restrictive orifices 70, 72 may be omitted, if desired. Hydraulic system 22 may also include a check valve 76 disposed between proportional pressure compensating valve 36 and upstream fluid passageway 60.

Figure 2:
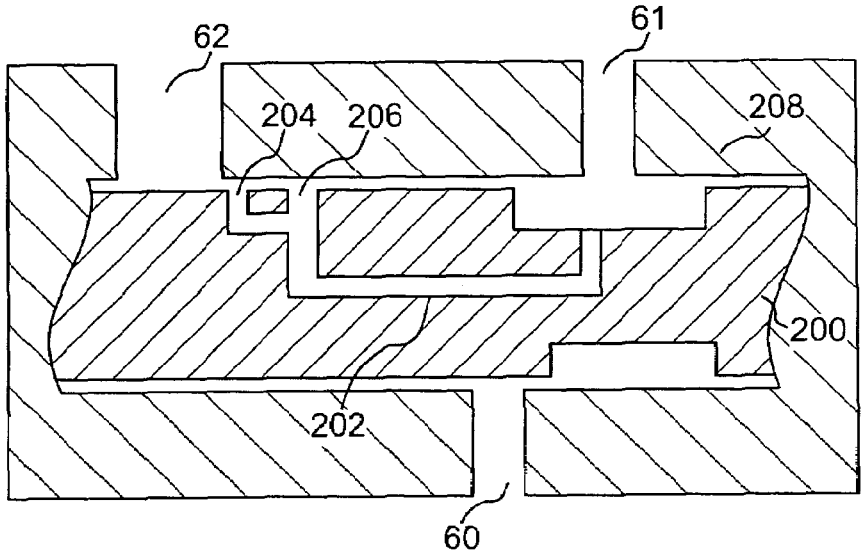
FIG. 2 is a cross-section diagrammatic illustration of an exemplary disclosed valve for the hydraulic system of FIG. 1 in a flow blocking position.
Figure 3:
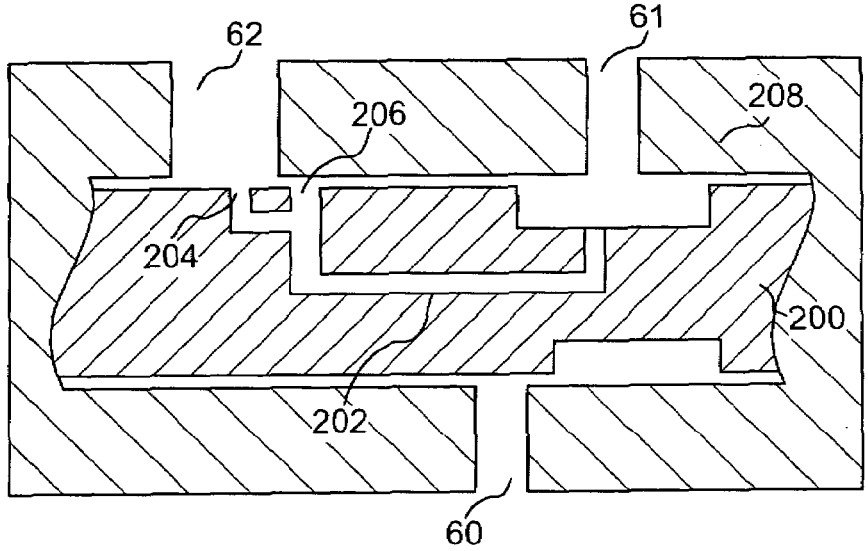
FIG. 3 is a cross-section diagrammatic illustration of an exemplary disclosed valve for the hydraulic system of FIG. 1 in a transition position.
Figure 4:
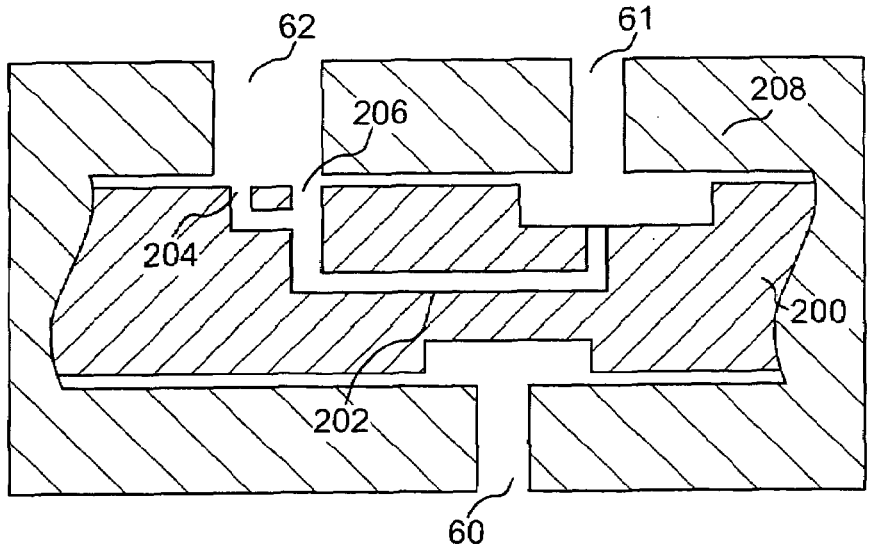
FIG. 4 is a cross-section diagrammatic illustration of an exemplary disclosed valve for the hydraulic system of FIG. 1 in a flow passing position.

FIGS. 2–4 illustrate an example of gradual flow valve element 200 in bore 208 of head-end supply valve 26. The description and operation of gradual flow valve element 200 of head-end supply valve 26 is similar to gradual flow valve element 210 of rod-end supply valve 30 and only a detailed description of valve element 200 is provided below. Gradual flow valve element 200 may include a valve signal passageway 202 and first and second orifices 204, 206 configured to be in fluid communication with valve signal passageway 202. Valve signal passageway 202 may be configured to communicate a signal pressure indicative of pressure supplied to first chamber 50 to first and second orifices 204, 206. First orifice 204 may be configured to communicate signal pressure of valve signal passageway 202 with system signal passageway 62 before second orifice 206 communicates signal pressure of valve signal passageway 202 with system signal passageway 62. For example, first orifice 204 may be fluidly communicated with system signal passageway 62 before second orifice 206 may be fluidly communicated with system signal passageway 62 when gradual flow valve element 200 is in a transition position. Gradual flow valve element 200 may be in a transition position when gradual flow valve element 200 moves from a flow blocking position to a flow passing position. It is contemplated that first and second orifices 204, 206 may be restricted to reduce pressure and/or flow oscillations therein. It is also contemplated that valve signal passageway 202 may be configured to be in fluid communication with common supply passageway 61 to communicate signal pressure indicative of fluid pressure supplied to first chamber 50. It is further contemplated that first and second orifices 204, 206 may alternatively embody grooves, notches, or any other type of fluid communication element known in the art.

FIG. 2 illustrates gradual flow valve element 200 in a flow blocking position. In a flow blocking position, valve signal passageway 202 may be configured to be in fluid communication with a pressure indicative of a pressure supplied to first chamber 50. Also, gradual flow valve element 200 may block fluid from flowing from source 24 to first chamber 50 by blocking fluid from flowing from upstream common fluid supply passageway 60 to first chamber fluid passageway 61.

FIG. 3 illustrates gradual flow valve element 200 in an exemplary transition position, between a flow blocking position and a flow passing position. In a transition position, first orifice 204 may be configured to communicate signal pressure of valve signal passageway 202 with system signal passageway 62 before second orifice 206 may communicate signal pressure of valve signal passageway 202 with system signal passageway 62. Specifically, first orifice 204 may be configured to fluidly connect signal passageway 202 and system signal passageway 62 thereby fluidly communicating an initial amount of signal pressure with system signal passageway 62, and second orifice 206 may not be configured to fluidly communicate signal passageway 202 and system signal passageway 62. Additionally, gradual flow valve element 200 may block fluid from flowing from source 24 to first chamber 50 by blocking fluid from flowing from upstream common fluid supply passageway 60 to first chamber fluid passageway 61. It is contemplated that any position of gradual flow valve element 200 between a flow blocking position, at which fluid is blocked from flowing to first chamber 50, and a flow passing position, at which fluid is allowed to flow to first chamber 50, may be a transition position. It is further contemplated that second orifice 206 may be configured to fluidly connect signal passageway 202 and system signal passageway 62 in a transition position subsequent to a transition position at which first orifice 204 fluidly connects signal passageway 202 and system signal passageway 62. That is, as gradual flow valve element 200 moves from a flow blocking position to a transition position, first orifice may fluidly connect valve signal passageway 202 to system signal passageway 62 and as gradual flow valve element 200 continues to move to a subsequent transition position, first and second orifices 204, 206 may fluidly connect valve signal passageway 202 to system signal passageway 62.

FIG. 4 illustrates gradual flow valve element 200 in a flow passing position. In a flow passing position, first and second orifices 204, 206 may be configured to communicate signal pressure of signal passageway 202 with system signal passageway 62. Specifically, first and second orifices 204, 206 may be configured to fluidly communicate an increased amount of signal pressure with system signal pressure passageway 62. Additionally, gradual flow valve element 200 may allow fluid to flow from source 24 to first chamber 50 by allowing fluid to flow from upstream common fluid supply passageway 60 to first chamber fluid passageway 61.

INDUSTRIAL APPLICABILITY

The disclosed valve may be applicable to any hydraulic system that includes a fluid actuator where gradually communicated signal pressure to a compensating valve is desired. The disclosed valve may provide high response pressure regulation that protects the components of the hydraulic system and provides consistent actuator performance in a low cost simple configuration. Additionally, the disclosed valve and, in particular, the gradually communicated signal pressure may reduce pressure surges within hydraulic circuit 22. The operation of hydraulic system 22 is explained below.

Hydraulic cylinder 16 may be movable by fluid pressure in response to an operator input. Fluid may be pressurized by source 24 and directed to head-end and rod-end supply valves 26 and 30. In response to an operator input to either extend or retract piston assembly 48 relative to tube 46, one of gradual flow valve elements 200, 210 of one of head-end and rod-end supply valves 26, 30 may move to the open position to direct the pressurized fluid to the appropriate one of first and second chambers 50, 52. Substantially simultaneously, one of the valve elements of one of head-end and rod-end drain valves 28, 32 may move to the open position to direct fluid from the appropriate one of the first and second chambers 50, 52 to tank 34 to create a pressure differential across piston 54 that causes piston assembly 48 to move. For example, if an extension of hydraulic cylinder 16 is requested, head-end supply valve 26 may move to the open position to direct pressurized fluid from source 24 to first chamber 50. Substantially simultaneous to the directing of pressurized fluid to first chamber 50, rod-end drain valve 32 may move to the open position to allow fluid from second chamber 52 to drain to tank 34. If a retraction of hydraulic cylinder 16 is requested, rod-end supply valve 30 may move to the open position to direct pressurized fluid from source 24 to second chamber 52. Substantially simultaneous to the directing of pressurized fluid to second chamber 52, head-end drain valve 28 may move to the open position to allow fluid from first chamber 50 to drain to tank 34.

Because multiple actuators may be fluidly connected to source 24, the operation of one of the actuators may affect the pressure and/or flow of fluid directed to hydraulic cylinder 16. If left unregulated, these effects could result in inconsistent and/or unexpected motion of hydraulic cylinder 16, and could possibly result in shortened component life of hydraulic system 22. Proportional pressure compensating valve 36 may account for these effects by proportionally moving the proportional valve element of proportional pressure compensating valve 36 between the flow passing and flow blocking positions in response to fluid pressures within hydraulic system 22 to provide a substantially constant predetermined pressure drop across all supply valves of hydraulic system 22.

As the pressure from source 24 drops, proportional pressure compensating valve 36 may move toward the flow passing position and thereby maintain the pressure within upstream common fluid passageway 60. Similarly, as the pressure from source 24 increases, proportional pressure compensating valve 36 may move toward the flow blocking position to thereby maintain the pressure within upstream common fluid passageway 60. Proportional pressure compensating valve 36 may be biased between the flow passing position and the flow blocking position as a result of the balance of pressure forces acting thereon. For example, signal pressure from fluid passageway 82, as communicated from system signal passageway 62 via shuttle valve 74, and the proportional pressure compensating valve spring may bias proportional pressure compensating valve 36 toward the flow passing position and fluid pressure from fluid passageway 78 may bias proportional pressure compensating valve 36 toward the flow blocking position. In this manner, proportional pressure compensating valve 36 may regulate the fluid pressure within hydraulic system 22 to maintain a desired pressure therein. The above description is representative of a fully operational mode of hydraulic system 22 in which one of head-end and rod-end valves 26, 30 is completely in a flow passing position. It is understood that in a fully operational mode, hydraulic system 22 is a dynamic system with varying pressures supplied to hydraulic system 22 from source 24 and with varying pressures within hydraulic system 22.

Because proportional pressure compensating valve 36 is hydro-mechanically actuated, pressure fluctuations within hydraulic system 22 may be quickly accommodated before they can significantly influence movement of hydraulic cylinder 16 or life of components within hydraulic system 22. In particular, the response time of proportional pressure compensating valve 36 may in some cases be much faster than typical solenoid actuated valves. In addition, the cost of hydraulic system 22 may be minimized because proportional pressure compensating valve 36 may be hydro-mechanically actuated rather than electronically controlled.

Furthermore, because proportional pressure compensating valve 36 moves in response to signal pressure from system signal passageway 62, significantly low signal pressure communicated to proportional pressure compensating valve 36 could affect the operation of actuator 16. If left unadjusted, these effects may result in undesirable and/or jerky movement of actuator 16. Gradual flow valve elements 200, 210 may reduce the effects of significantly low pressure signals by gradually communicating signal pressure to proportional pressure compensating valve 36.

Without a gradually communicated signal pressure, a significantly low signal pressure may be communicated to proportional pressure compensating valve 36 as one of head-end and rod-end supply valves 26, 30 is moved from the flow blocking position to the flow passing position. This significantly low signal pressure may be communicated from first chamber fluid passageway 61. The pressure within first chamber fluid passageway 61 may be controlled to be below a predetermined pressure by head-end pressure relief valve 38 and above a pressure of fluid within tank 34 by head-end make-up valve 40 and may be significantly lower than a pressure of fluid supplied to hydraulic system 22 by source 24.

This significantly low signal pressure may be communicated to proportional pressure compensating valve 36 via shuttle valve 74 and may act together with the force of the proportional pressure compensating valve spring against the pressure from fluid passageway 78 to bias the proportional valve element of proportional pressure compensating valve 36. The significantly low signal pressure may be significantly lower than the pressure of the fluid within fluid passageway 78 and may cause a significant force imbalance on the proportional valve element of proportional pressure compensating valve 36 resulting in rapid movement thereof toward the flow blocking position. This rapid movement could generate a pressure surge through passageway 82, through opened shuttle valve 74, through the flow passing valve, and to fluid actuator 16 resulting in undesirable and/or jerky movement of actuator 16. This pressure surge may be reduced by gradually communicating signal pressure to proportional pressure compensating valve 36 as one of head-end and rod-end supply valves 26, 30 is moved to the flow passing position.

The operation of gradual flow valve 200 and hydraulic system 22 as discussed below is based upon an exemplary operation of hydraulic system 22 for clarification purposes only. It is understood that the discussion below may be applicable to various operational conditions of hydraulic system 22 with different system pressures, and is not to be construed as limiting.

When head-end and rod-end valves 26, 30 are each in a closed position (FIG. 1) shuttle valve 74 may be in a closed position due to a balance of the pressures communicated to system signal passageway 62 on either side of shuttle valve 74 via pressure balancing passageways 66, 68. Head-end and rod-end valves 26, 30 may each be in a closed position when an operator desires fluid actuator 16 to maintain a fixed position. As such, shuttle valve 74 may not communicate signal pressure from system signal passageway 62 to proportional pressure compensating valve 36. However, signal pressure maintained within fluid passageway 82 may still bias proportional pressure compensating valve 36 against fluid within fluid passageway 78 to a desired flow passing position in response to varying pressure supplied from source 24.

As head-end valve 26 moves from a flow blocking position to a flow passing position, gradual flow valve element 200 moves from a flow blocking position (FIG. 2) into a transition position (FIG. 3) and finally to a flow passing position (FIG. 4). Head-end valve 26 may move from a flow blocking position to a flow passing position when an operator desires fluid actuator 16 to extend. When gradual flow valve element 200 moves from the flow blocking position (FIG. 2) to a transition position (FIG. 3), first orifice 204 may fluidly communicate valve signal passageway 202 and system signal passageway 62 to thereby communicate an initial signal pressure to the flow passing valve side of shuttle valve 74. As referenced above, valve signal passageway 202 may be in fluid communication with first chamber fluid passageway 61 and the pressure of fluid within first chamber fluid passageway 61 may be lower than the pressure communicated to system signal passageway 62 via pressure balancing passageway 66.

The initial signal pressure may combine with the pressure of fluid communicated via pressure balancing passageway 66 and thereby equalize to a resultant first signal pressure that may be lower than the pressure supplied to the flow blocking valve side of shuttle valve 74 via pressure balancing passageway 68. Shuttle valve 74 may accordingly be biased by the first signal pressure to fluidly communicate the first signal pressure with proportional pressure compensating valve 36 via fluid passageway 82. This communicated first signal pressure may be less than the pressure of fluid previously acting on proportional pressure compensating valve 36 through passageway 82, and thus may cause a first pressure imbalance on the proportional valve element of proportional pressure compensating valve 36 resulting in an initial movement of proportional pressure compensating valve 36 toward a flow blocking position. It is contemplated that the initial signal pressure communicated to system signal passageway 62 may be controlled such that the resulting first signal pressure is not significantly less than the pressure of fluid within fluid passageway 78 and thus may result in a relatively small movement of proportional pressure compensating valve 36 toward the flow blocking position.

As gradual flow valve element 200 continues to move toward a flow passing position (FIG. 4), first and second orifices 204, 206 may fluidly communicate valve signal passageway 202 and system signal passageway 62 to thereby communicate a subsequent signal pressure to the flow passing valve side of shuttle valve 74. Similar to initial signal pressure, the subsequent signal pressure may be lower than pressure communicated to system signal passageway 62 via pressure balancing passageway 66.

The subsequent signal pressure may combine with the pressure of fluid communicated via pressure balancing passageway 66 and thereby equalize to a resultant second signal pressure that may also be lower then the pressure communicated to the flow blocking valve side of shuttle valve 74 via pressure balancing passageway 68. Shuttle valve 74 may accordingly be biased by the second signal pressure to continue to fluidly communicate the second signal pressure with proportional pressure compensating valve 36 via fluid passageway 82. This second signal pressure may also be less than the pressure of fluid within fluid passageway 78 and may cause a second pressure imbalance on the proportional valve element of proportional pressure compensating valve 36 resulting in further movement of proportional pressure compensating valve 36 toward the flow blocking position. It is contemplated that the subsequent signal pressure communicated to system signal passageway 62 may be controlled such that the resulting second pressure imbalance may be greater than the first signal pressure imbalance thereby resulting in a greater movement of proportional pressure compensating valve 36 toward the flow blocking position.

When gradual flow valve element 200 is completely in a flow passing position (FIG. 4), first and second orifices 204, 206 may continue to fluidly communicate the subsequent signal pressure with system passageway 62. Similar to above, the subsequent signal pressure may continue to combine with the pressure of fluid communicated via pressure balancing passageway 66 and equalize to the resultant second signal pressure to be communicated via shuttle valve 74 to proportional pressure compensating valve 36. When gradual flow valve element 200 is completely in a flow passing position (FIG. 4) hydraulic system 22 may be in a fully operational mode and continued communication of second signal pressure to proportional pressure compensating valve element 36 may provide the desired regulation of fluid pressures within hydraulic system 22. It is contemplated that when gradual flow valve element 200 is completely in a flow passing position (FIG. 4), the pressure of second signal pressure may vary as a result of the varying pressures supplied to hydraulic system from source 24 and from the varying pressures within hydraulic system 22 to correspondingly move proportional pressure compensating valve 36 between a flow passing and a flow blocking position.

Because gradual flow valve element 200 communicates initial and subsequent signal pressures with system signal passageway 62, a gradually communicated signal pressure may be communicated with proportional pressure compensating valve 36 and movement thereof may be gradual when head-end supply valve 26 moves from a flow blocking position to a flow passing position. This gradually communicated signal pressure may act to ease the movement of the proportional valve element of proportional pressure compensating valve 36 and may reduce undesirable and/or jerky movement of actuator 16 caused by a rapid actuation of the proportional valve element of proportional pressure compensating valve 36. It is contemplated that the amount of signal pressure communicated to system signal passageway 62 may increase or, alternatively, that the pressure of signal pressure communicated to system signal passageway 62 may decrease to provide a gradually communicated signal pressure to proportional pressure compensating valve 36. It is further contemplated that a diameter of the second orifices of gradual flow valve elements 200, 210 of head-end and rod-end supply valves 26, 30 may be greater than a diameter of the first orifices of gradual flow valve elements 200, 210 of head-end and rod-end supply valves 26, 30, respectively.

It will be apparent to those skilled in the art that various modifications and variations can be made to the disclosed valve and hydraulic system. Other embodiments will be apparent to those skilled in the art from consideration of the specification and practice of the disclosed valve and hydraulic system. It is intended that the specification and examples be considered as exemplary only, with a true scope being indicated by the following claims and their equivalents.

What is claimed is:

1. A valve for a hydraulic system having a source of pressurized fluid, a fluid actuator, and a proportional pressure compensating valve, the valve comprising:

a bore in fluid communication with the source and the fluid actuator;

a valve element disposed within the bore and movable between a flow blocking position and a flow passing position to selectively fluidly communicate the source with the fluid actuator;

a valve signal passageway disposed within the valve element and configured to be in fluid communication with a pressurized fluid having a signal pressure indicative of pressure supplied to the fluid actuator;

first and second orifices disposed in the valve element and in fluid communication with the valve signal passageway;

wherein the valve signal passageway is configured to communicate the signal pressure with the first and second orifices;

wherein movement of the valve element from the flow blocking position to the flow passing position fluidly communicates the first orifice with a system signal passageway before the second orifice, and fluidly communicates both the first and second orifices with the system signal passageway when the valve element is in the flow passing position, and wherein the valve element does not fluidly communicate the first orifice with the system signal passageway when the valve element is in the flow blocking position.

2. The valve of claim 1, wherein the second orifice is configured to pass a larger flow of signal pressure than the first orifice.

3. The valve of claim 2, wherein a size of the second orifice is configured to be greater than a size of the first orifice.

4. The valve of claim 1, wherein movement of the valve element from the flow blocking position to the flow passing position fluidly communicates the first and second orifices to the system signal passageway before the valve element is completely in the flow passing position.

5. The valve of claim 1, wherein movement of the valve element from the flow blocking position to the flow passing position fluidly provides an initial flow of signal pressure; and wherein continued movement of the valve element from the flow blocking position to the flow passing position fluidly provides an increased flow of signal pressure.

6. A method of operating a valve, comprising:

pressurizing a fluid;

directing pressurized fluid to the valve;

moving a valve element between a flow blocking position and a flow passing position to selectively communicate pressurized fluid to a fluid actuator via the valve;

directing pressurized fluid having a signal pressure indicative of pressure supplied to the fluid actuator through a valve signal passageway disposed within the valve element; and communicating pressurized fluid through a first orifice disposed within the valve element with a system signal passageway as the valve element moves from a flow blocking position to a flow passing position before communicating pressurized fluid through a second orifice disposed within the valve element with the system signal passageway as the valve element moves from the flow blocking position to the flow passing position, wherein the pressurized fluid associated with the system signal passageway is indicative of the pressure supplied to the fluid actuator.

7. The method of claim 6, further including:

directing pressurized fluid from the system signal passageway to a proportional pressure compensating valve via a shuttle valve disposed within the system signal passageway in response to a pressure of a fluid within the system signal passageway.

8. The method of claim 6, further including:

directing pressurized fluid from the valve to a first chamber of a fluid actuator.

9. The method of claim 6, wherein the valve is a first valve and the method further includes:

directing pressurized fluid to a second valve;

moving a second valve element between a flow blocking position and a flow passing position to selectively communicate pressurized fluid to the fluid actuator via the second valve;

directing pressurized fluid having a signal pressure indicative of pressure supplied to the fluid actuator through a second valve signal passageway disposed within the second valve element; and communicating pressurized fluid through a first orifice disposed within the second valve element with the system signal passageway as the second valve element moves from a flow blocking position to a flow passing position before communicating pressurized fluid through a second orifice disposed within the second valve element with the system signal passageway as the second valve element moves from the flow blocking position to the flow passing position.

10. The method of claim 9, further including directing pressurized fluid from the second valve to a second chamber of the fluid actuator.

11. The method of claim 9, further including selectively operating the first and second valve elements to move the actuator.

12. The method of claim 9, further including, directing pressurized fluid from the system signal passageway to the pressure compensating valve element via a shuttle valve in response to a pressure of a fluid within the system signal passageway.

13. The method of claim 9, further including:

directing a larger flow of signal pressure through the second orifices of the first and second valves than through the first orifices of the first and second valves.

14. A hydraulic system, comprising:

a source of pressurized fluid;

a fluid actuator having a first chamber and a second chamber;

a proportional pressure compensating valve configured to control pressures of fluid supplied to the first and second chambers;

at least one valve configured to selectively fluidly communicate the source with the first chamber, the at least one valve having a bore in fluid communication with the source and the first chamber;

a valve element disposed within the bore and movable between a flow blocking position and a flow passing position to selectively fluidly communicate the source with the fluid actuator;

a valve signal passageway disposed within the valve element and configured to be in fluid communication with a pressurized fluid having a signal pressure indicative of pressure supplied to the first chamber;

first and second orifices disposed in the valve element and in fluid communication with the valve signal passageway;

wherein the valve signal passageway is configured to communicate the signal pressure with the first and second orifices; and wherein movement of the valve element from the flow blocking position to the flow passing position fluidly communicates the first orifice with a system signal passageway before the second orifice, and fluidly communicates both the first and second orifices with the system signal passageway when the valve element is in the flow passing position to supply a flow of pressurized fluid having a decreasing pressure from the valve signal passageway toward the system signal passageway.

15. The hydraulic system of claim 14, wherein the valve is disposed downstream of the proportional pressure compensating valve.

16. The hydraulic system of claim 14, wherein the at least one valve is a first valve and the hydraulic system further includes:

a second valve configured to selectively fluidly communicate the source with the second chamber, the second valve having a second bore in fluid communication with the source and the fluid actuator;

a second valve element disposed in the second bore and movable between a flow blocking position and a flow passing position to selectively fluidly communicate the source with the second chamber;

a second valve signal passageway disposed within the second valve element and configured to be in fluid communication with a pressurized fluid having a second signal pressure indicative of pressure supplied to the second chamber;

third and fourth orifices disposed in the second valve element and in fluid communication with the second valve signal passageway;

wherein the second valve signal passageway is configured to communicate the second signal pressure with the third and fourth orifices; and wherein movement of the second valve element from the flow blocking position to the flow passing position fluidly communicates the third orifice with the system signal passageway before the fourth orifice, and fluidly communicates both the third and fourth orifices with the system signal pressure passageway when the second valve element is in the flow passing position.

17. The hydraulic system of claim 16, wherein the hydraulic system further includes:

a shuttle valve disposed within the system signal passageway;

wherein the shuttle valve selectively passes pressurized fluid from the system signal passageway in response to a fluid pressure within the system signal passageway.

18. The hydraulic system of claim 14, wherein the second orifice is configured to pass a larger flow of signal pressure than the first orifice.

19. The hydraulic system of claim 16, wherein the fourth orifice is configured to pass a larger flow of signal pressure than the third orifice.

20. The hydraulic system of claim 16, wherein:

a size of the second orifice is greater than the size of the first orifice; and a size of the fourth orifice is greater than the size of the third orifice.

21. A hydraulic system, comprising:

a source of pressurized fluid;

a fluid actuator;

a proportional pressure compensating valve configured to control pressures of fluid supplied to the fluid actuator, the proportional pressure compensating valve having a proportional valve element; and at least one valve configured to selectively fluidly communicate the source with the fluid actuator, the at least one valve having a valve element;

wherein movement of the valve element from a flow blocking position to a flow passing position fluidly communicates a gradually decreasing signal pressure configured to gradually bias the proportional valve element.

22. The hydraulic system of claim 21, further including:

a shuttle valve configured to fluidly communicate the gradual signal pressure with the proportional pressure compensating valve.

23. The hydraulic system of claim 22, wherein the shuttle valve fluidly communicates an increasing flow of fluid with the proportional pressure compensating valve.

24. The hydraulic system of claim 21, wherein the at least one valve further includes:

a valve signal passageway disposed within the valve element; and first and second orifices disposed in the valve element and in fluid communication with the valve signal passageway;

wherein the valve signal passageway is configured to communicate the signal pressure with the first and second orifices; and wherein movement of the valve element from the flow blocking position to the flow passing position fluidly communicates the first orifice with a system signal passageway before the second orifice, and fluidly communicates both the first and second orifices with the system signal pressure passageway when the valve element is in the flow passing position.

* * * * *